United States Patent [19]

Whysall

[11] 3,934,314

[45] Jan. 27, 1976

[54] BUTTONS

[75] Inventor: William Arthur Whysall, Albrighton, England

[73] Assignee: Newey Goodman Limited, Birmingham, England

[22] Filed: Apr. 8, 1974

[21] Appl. No.: 459,163

[30] Foreign Application Priority Data

Aug. 8, 1973 United Kingdom ..... 37510/73

[52] U.S. Cl. ..... 24/113 R

[51] Int. Cl.[2] ..... A44B 1/12

[58] Field of Search ..... 24/90 A, 90 C, 90 PR, 92, 24/113, 90, 113 R

[56] References Cited

UNITED STATES PATENTS

| | | | |
|---|---|---|---|
| 1,169,912 | 2/1916 | Barbour | 24/113 R X |
| 2,602,975 | 7/1952 | Wolfe | 24/113 R |
| 2,799,908 | 7/1957 | Morin | 24/113 R |
| 2,977,653 | 4/1961 | Adinolfi | 24/113 R |
| 3,412,578 | 11/1968 | Rosencrans | 24/113 R X |
| 3,425,101 | 2/1969 | Reynolds | 24/113 R |
| 3,449,802 | 6/1969 | Mackey | 24/113 R |

FOREIGN PATENTS OR APPLICATIONS

| | | | |
|---|---|---|---|
| 555,191 | 3/1957 | Belgium | 24/113 R |
| 68,696 | 12/1944 | Norway | 24/113 R |

*Primary Examiner*—Donald A. Griffin

*Attorney, Agent, or Firm*—Scrivener Parker Scrivener and Clarke

[57] ABSTRACT

A button is assembled from two components and a piece of fabric. One of those components, the support, has a head and an axial stem at the rear, while the other, the retainer, is of frusto-conical or other tapered shape, having a central hole to receive the stem. The fabric extends over the front of the support and around the edge of the head to the rear thereof. The marginal part of the fabric is trapped between the broader end of the retainer and the rear of the head. The stem has at least one undercut, and engagement means at the narrower end of the retainer snaps into the undercut or undercuts to maintain the button in the assembled state.

5 Claims, 4 Drawing Figures

BUTTONS

Figure 1:
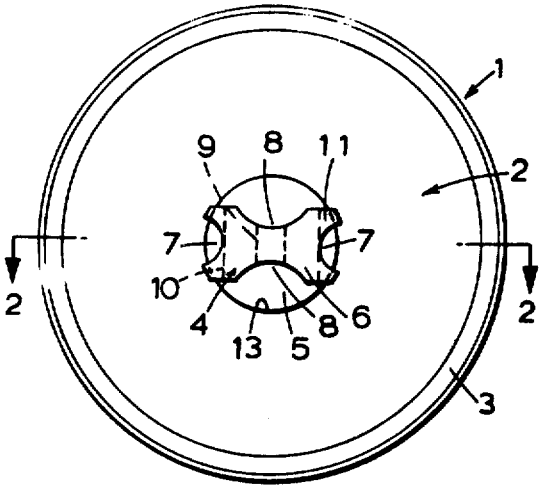

This invention relates to buttons, and in particular to buttons of the kind comprising a support, a piece of fabric extending over the front of the support and around the edge of the support to the rear thereof, and a retainer assembled with the support, at the rear of the support, the arrangement being such that the marginal parts of the fabric are trapped between the retainer and the support.

Components from which buttons of the kind specified can be assembled, and in particular kits comprising supports and retainers, are often marketed for assembly by the housewife, or amateur dressmaker, who provides her own fabric for incorporation in the buttons, the fabric being selected to match the particular garment or other article with which the completed buttons are to be used.

The invention also relates, therefore, to components, namely a support and a retainer, which are suitable for assembly with a piece of fabric to form a button of the kind specified.

There are already known various designs of buttons of the kind outlined above. In one known design, for example, the support comprises a head with an axial stem at the rear, and the retainer comprises a sheet metal disc, the periphery of which is formed with teeth. The disc has a central hole and can be pushed onto the stem of the support, the stem passing through the central hole in the disc. The disc is also formed with resilient tongues which border the central hole and resiliently engage the stem of the support.

The design has several disadvantages, Firstly, the tongues have to bite into the stem in order to retain the disc in place, with the result that the disc cannot be removed without the tongues damaging the stem. Secondly the disc has to be sufficiently stiff to ensure that the peripheral teeth firmly engage the fabric. In consequence the tongues are also relatively stiff, and tend not to engage the stem satisfactorily.

The aim of the present invention is to overcome the disadvantages of the known designs of buttons.

From one aspect the present invention comprises the components for a button of the kind comprising a support, a piece of fabric extending over the front of the support and around the edge of the support to the rear thereof, and a retainer assembled with the support, at the rear of the support, the marginal parts of the fabric being trapped between the retainer and the support, said components comprising a support and a retainer, the support comprising a head with an axial stem at the rear formed with at least one preformed undercut, and the retainer being of generally frusto-conical or other tapered shape, having a central hole which can receive said stem, the arrangement being such that when the button is assembled the marginal parts of the fabric can be trapped between the broader end of the retainer and the rear of the head, and engagement means at the narrower end of the retainer snaps into the undercut or undercuts in the stem so as to maintain the button in the assembled state.

From another aspect the present invention consists in button components as outlined in the last preceding paragraph and assembled together with a piece of fabric.

Because the retainer is of generally frustoconical or other tapered shape, the broader end of the retainer is held against the fabric by thrust forces in the retainer rather than by bending-moment forces, as was the case with the metal disc described above. Therefore the retainer need not be as stiff and massive as that previously used. Further, as the narrower end of the retainer snaps into a preformed undercut or preformed undercuts in the stem the retainer is positively held in place without damaging the stem. It may also be possible to remove and replace the retainer if desired, so as to enable the piece of fabric to be replaced by another piece of fabric.

The broader end of the retainer, or the rear of the head of the support, or each of these parts is preferably formed with teeth or like projections which serve in use to engage the fabric and assist in retaining the fabric in position.

The head of the support is preferably of domed shape and is preferably imperforate so that a continuous surface is present behind the fabric, and there are no irregularities in the front surface of the head such as might be visible and detract from the appearance of the button if an open-work, thin or translucent fabric is used.

If, as is preferred, the support is formed as a unitary moulding of a plastics material, and the dome-shaped head is imperforate, the or each undercut in the stem cannot be formed by a part of the mould projecting through the head but must generally be formed by a core movable in a direction transverse to the axis of the stem. To simplify manufacture as far as possible, the or each undercut is preferably formed by a core of that kind which can follow a rectilinear path without fouling the head of the support. Where there are more than one undercut the cores are preferably movable in parallel. Further, where the stem is formed with a transverse hole or holes through which thread can pass for enabling the button to be sewn in position, the thread hole or each thread hole preferably extends through the stem in the same direction so that there is only a single set of movable cores: a core or cores for the undercut or undercuts, and a core or cores for the thread hole or holes, the cores constituting the set being movable in the same direction in unison.

The arrangement is preferably such that during assembly of the components it is the retainer which is deformed or mainly deformed rather than the stem when the stem enters the central hole in the retainer but before the engagement means snaps into the undercut or undercuts in the stem. There may well be some small deformation of the stem, in that preferred arrangement, but the main deformation occurs in the retainer.

The engagement means is preferably of annular form, extending around the central hole in the retainer, the arrangement being such that the retainer can be assembled with the support in any relative rotational positions of the components. With such an arrangement it is unnecessary to rotate the retainer to a particular position (or any one of a group or range of particular positions) relative to the support before the components are assembled. The engagement means preferably comprises the marginal part of the retainer around the central hole in the retainer.

In order to enable the retainer to be readily deformed during assembly of the components as described above, the retainer is preferably of relatively thin section, and has a tapered interior corresponding at least in general shape to the tapered exterior. When, as is preferrrd, the central hole in the retainer is of circular shape the stem, or at least that part thereof to the rear of the undercut or undercuts, is preferably of non-circular shape in cross-section, the arrangement being such that when the retainer is being urged over that rear part of the stem the retainer is not stretched to any significant extent to enlarge the central hole, but is resiliently deformed so as to alter the shape of the hole. For example, if the part of the stem to the rear of the undercut part is square, rectangular or of other polygonal shape in cross-section the arrangement is preferably such that as that rear part of the stem passes through the central hole the retainer is resiliently deformed so that the hole temporarily assumes a complementary shape.

In order to strengthen the retainer without much reducing its ability to be deformed in that manner the retainer is preferably formed with stiffening ribs or like formations extending in directions which are generally radially outward in relation to the central hole. Such ribs or like formations tend to resist any tendency for the retainer to collapse in use and take up the shape of the bell of a trumpet. If the retainer were to collapse into such a shape there would of course be a tendency for the grip on the fabric to be relaxed and a tendency for the engagement means to leave the undercut or undercuts.

Figure 2:
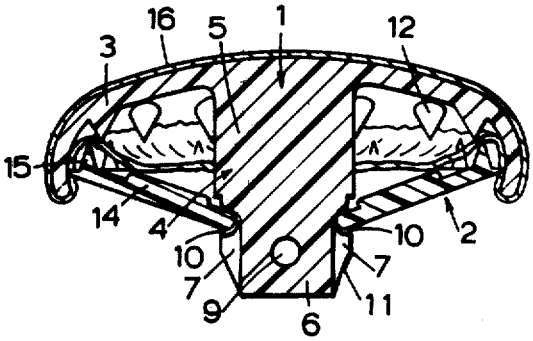
Figure 3:
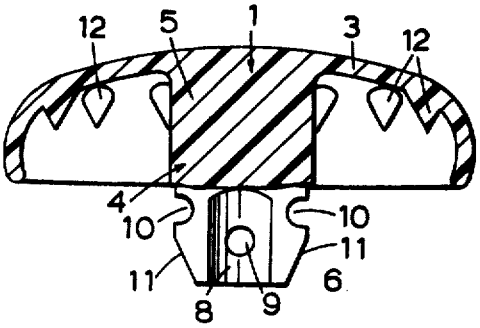
Figure 4:
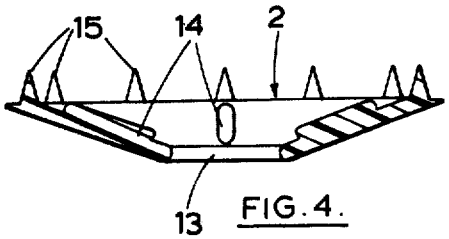

Button components and a button assembled from those components, embodying the invention and the preferred features thereof outlined above, will now be described in greater detail with reference to the accompanying drawings, in which FIG. 1 is a rear view of the assembled components, but without a piece of fabric, FIG. 2 is a section on the line 2—2 of FIG. 1, but showing a piece of fabric trapped in position, FIG. 3 is a side view of the support, partly in section along line 2—2 of FIG. 1, and FIG. 4 is a section through the retainer also along the line 2—2 of FIG. 1.

The button components comprise a support 1 and a retainer 2. Each of those components is formed as a unitary moulding of a plastics material, a suitable material being a white, translucent nylon. The components can both be formed in the same mould, the mould having a plurality of impressions for the support and an equal number of impressions for the retainer.

The support 1 comprises a hollow, domed head 3 of which the curvature increases towards the edge, the marginal portion being slightly re-entrant so that the maximum internal diameter of the head is slightly greater than the internal diameter of the entrance of the hollow interior of the head.

An integral stem 4 projects axially from the interior of the head 3. That part 5 of the stem 4 within the head 3 is of circular cross-section, its length being approximately equal to its diameter. That part 6 of the stem 4 which projects beyond the entrance to the hollow interior of the head 3 is of about the same length as the part 5 but is of more complex shape. The projecting part 6 is of generally rectangular, oblong shape in end view (as shown in FIG. 1), the corners of the rectangle being aligned with the circumference of the part 5 of circular cross-section. Each of the four side faces of the projecting part 6 of the stem 4 is formed with a groove of shallow arcuate shape in cross-section and extending in a direction parallel with the axis of the stem, the grooves in the narrow faces being numbered 7, and the grooves in the broader faces being numbered 8. A thread hole 9 of circular cross-section extends transversely through the projecting part 6 of the stem 4, at right angles to the broader side faces of the projecting part, and interconnecting the grooves 8 in those broader side faces. Undercuts 10, each of semi-circular cross-section, and parallel with the thread hole 9, are formed in each of the two narrower side faces. Each of the narrower side faces thus has an undercut 10 at right angles to the groove 7 in that side face and intersecting that groove. The undercuts 10 are somewhat closer to that part 5 of the stem which is of circular cross-section than is the thread hole 9. Between the outer end of the stem 4 and each of the undercuts 10 the stem is chamfered, as indicated at 11, so that the grooves 7 in the narrower side faces of the projecting part 6 of the stem 4 do not extend as far as the flat outer end face of the stem 4.

Teeth or studs 12 are provided in the head 3 for engagement with a piece of fabric as described below. The teeth or studs 12 are disposed in a circle co-axial with the stem 4 and spaced outwards from the stem inside the hollow interior of the head. The diameter of the circle is only a little less than that of the entrance to the hollow interior of the head 3. There may, for example, be twelve uniformly spaced teeth or studs 12, each tooth or stud being of conical shape with an included angle of 45° at the apex. The axis of each tooth or stud 12 is parallel with the axis of the stem 4.

Each support 1 is formed in the mould so that the two principal parts of the mould separate in a direction parallel with the axis of the stem 4. The thread hole 9 and undercuts 10 in each support are formed by cores mounted on a common slide movable in a direction normal to the direction in which the principal parts of the mould separate.

The other of the components, the retainer 2, is of generally frusto-conical shape, and of uniform wall thickness. The included angle at the apex of the notional cone of which it forms a part is 116°. There is a central, circular hole 13 at the narrower end of the retainer 2, the marginal part of the retainer around that hole constituting the engagement means referred to above. Four integral stiffening ribs 14 are formed on the inside surface of the retainer, those ribs extending radially outwards from the axis and being spaced uniformly about the axis. Each rib 14 extends from a position spaced a short distance from the central hole 13 in the narrower end of the retainer to a position adjacent to but spaced a short distance from the broader end of the retaier.

Teeth or studs 15, similar to those numbered 12 in the head 3 of the support 1, are also provided at the broader end of the retainer 2, there being the same number of teeth or studs 15 on the retainer 2 as there are teeth or studs 12 in the head 3. The bases of the teeth or studs 15 on the retainer 2 are just inside the mouth of the retainer, and the teeth or studs project outwards from the mouth of the retainer in a direction parallel with the axis of the retainer.

The dimensions of the support 1 and the retainer 2 are such that these components can be assembled with a piece of fabric 16, in the manner now to be described, and illustrated in FIG. 2. The piece of fabric 16 is of circular shape and is pulled taut over the convex front surface of the head 3 of the support 1, its marginal parts then being tucked inside the head 3 and extending over the teeth or studs 12 in the head, and terminating just short of the stem 4.

The retainer 2 is then pushed onto the stem 4 broader end first, the diameter of the broader end of the retainer being slightly smaller than that of the mouth of the hollow interior of the head 3 of the support 1. When the retainer 2 is pushed fully into position the edge of the retainer abuts the head 3 immediately outside the ring of teeth or studs 12 in the head, and the teeth or studs 15 on the retainer 2 lie in between those in the head. Although the retainer 2 is said to abut the head 3, the marginal part of the piece of material 16 does of course extend between these abutting parts, being trapped between them and gripped by the two sets of teeth or studs 12 and 15. The teeth or studs 12 and 15 may actually pierce the piece of fabric 16 or may merely engage it firmly without piercing it. Even if the fabric 16 is not torn its component threads may be forced apart to receive the teeth or studs 12 and 15. It will be appreciated that while the broader part of the retainer 2 is pushed into the head 3 the teeth or studs 15 on the retainer tend to engage the fabric and assist in pulling it taut over the front surface of the head.

During the final stages of assembly of the button the retainer 2 is somewhat deformed to enable the outer part 6 of the stem 4 of the support 1 to pass through the central hole 13 in the retainer without significant deformation of the stem. The chamfers 11 on the stem 4 are such as to enable the outer end part of the stem to enter the hole without any deformation. Further entry of the stem 4 into the hole 13 causes the hole to assume an approximately rectangular shape as described above. Finally, when the retainer 2 is pushed fully into position the engagement means bordering the central hole 13 snaps into the grooves constituting the undercuts 10. The dimensions of the components are such that although they are tightly assembled there is no significant permanent deformation of the components unless a particularly thick piece of fabric is used.

The assembled button can be secured to a garment or other article by threads passing through the thread hole 9 in the stem 4. The thread hole 9 is rather closer to the rear end of the stem than are the undercuts 10 so that the retainer does not interfere with the passage of a needle through the thread hole.

In order to assist in the assembly of the button a device (not shown) may be provided which is formed as a moulding from a suitable plastics material such as polythene or p.v.c. which is substantially rigid in thick section but is flexible in thin section. The moulding comprises a relatively short thick-walled tube of circular cross-section with an inwardly directed bead of semi-circular cross-section at one end of its bore. The other end of the bore is closed. The main part of the bore is slightly larger than the maximum external diameter of the support component 1 of the button, while the minimum diameter of the bore, where the bead is most thick, is slightly greater than the maximum diameter of the retainer 2.

When the button is to be assembled the piece of fabric 16 is placed over the open end of the assembly device. The support component 1 of the button is then pushed, head-first, into the bore of the device past the bead. This action stretches the fabric tightly over the head 3. The fabric-covered head 3 abuts the closed end of the device, which presents a complementary convex end surface, while the marginal part of the head lies just behind the bead so that the marginal part of the piece of fabric is turned inwards, due to the presence of the bead, towards the stem 4 of the support.

The broader end of the retainer 2 can then be pushed into the mouth of the domed head 3 as described above. This can readily be effected with the aid of a cotton reel, the stem of the support 4 entering the bore in the reel, and the reel then being pushed axially.

When the button has been assembled it can readily be withdrawn from the assembly device. In order to assist withdrawal there may be a small hole in the normally closed end of the device, and a tool may be pushed through that hole to urge the button from the device.

In an alternative method of assembly, dispensing with the need for the assembly device, a draw thread is tacked round the margin of the circular piece of fabric 16, and when the fabric is approximately placed in position on the head 3, the draw thread is pulled tight and thus causes the marginal parts of the fabric to be gathered around the stem 4. The retainer 2 is then placed on the stem 4 and pushed fully into position with the aid of a cotton reel as described above.

I claim:

1. Button components for a button of the kind comprising a support, a piece of fabric extending over the front of the support and around the edge of the support to the rear thereof, and a retainer assembled with the support, at the rear of the support, the marginal parts of the fabric being trapped between the retainer and the support, said components comprising a support and a retainer, the support comprising a head with an axial stem at the rear formed with undercutting constituted by at least one preformed undercut, and the retainer comprising a wall element of tapered shape and having a central hole which can receive said stem, the cross-section of that part of the stem to the rear of the undercutting having a maximum transverse dimension greater than that of the hole and a minimum transverse dimension less than that of the hole the arrangement being such that when the button is assembled and the stem is inserted into the hole with the narrower end of the retainer pointing away from the head of the support, the retainer can be resiliently deformed so that the hole temporarily assumes a shape such as to enable that part of the stem to the rear of the undercutting to pass through it without itself being significantly deformed and without the periphery of the hole being significantly stretched the cross-section of the stem at the undercutting being such that after that part of the stem to the rear of the undercutting has been passed through the hole the retainer can resiliently snap back to its initial shape, part of the retainer bordering the hole entering the undercutting in the stem so as to maintain the components in the assembled state, and the marginal parts of the fabric being at the same time trapped between the broader end of the retainer and the rear of the head.

2. Button components according to claim 1 in which the support is formed as a unitary moulding, and the stem is formed with a transverse thread hole which extends in a direction parallel with that of the undercutting in the stem.

3. Button components according to claim 1 in which the retainer is of annular form and extends around the central hole in the retainer and said hole is circular, the arrangement being such that the retainer can be assembled with the support in any relative rotational positions of the components.

4. Button components according to claim 1 in which the retainer is formed with stiffening ribs extending in directions which are generally radially outward in relation to the central hole.

5. A button comprising button components according to claim 1 assembled together with a piece of fabric.

* * * * *